US005934789A

United States Patent [19]

Sinclair et al.

[11] Patent Number: 5,934,789

[45] Date of Patent: Aug. 10, 1999

[54] DISPOSABLE PLANAR FLASHLIGHT

[76] Inventors: Iain Sinclair, P.O. Box 807, Hildersham, Cambridge CB1 6BX, United Kingdom; Allen Pearson, 107 Station Road, Warboys, Huntingdon, Cambs PE17 2th, United Kingdom

[21] Appl. No.: 08/914,188

[22] Filed: Aug. 19, 1997

[51] Int. Cl.[6] ..... F21L 7/00

[52] U.S. Cl. ..... 362/189; 362/200; 362/201; 362/205; 362/184

[58] Field of Search ..... 362/189, 200, 362/201, 205, 184, 394, 276

[56] References Cited

U.S. PATENT DOCUMENTS

| | | | |
|---|---|---|---|
| D. 367,720 | 3/1996 | Sinclair . | |
| 5,386,351 | 1/1995 | Tabor | 362/200 |
| 5,457,613 | 10/1995 | Vandenbelt . | |
| 5,515,248 | 5/1996 | Canfield et al. | 362/116 |

*Primary Examiner*—Sandra O'Shea
*Assistant Examiner*—Michael J. Smith
*Attorney, Agent, or Firm*—Price, Gess & Ubell

[57] ABSTRACT

An improved planar disposable flashlight is presented having a one-piece housing for mounting the elements of the flashlight in a fixed structural relationship while providing support and protection to the flashlight. The one piece housing includes a pair of resilient C-shaped clamps which releasably grasp a pair of light bulb shafts and position the light bulbs in a predetermined position, and a protective bumper is provided which separates the light bulbs and protects them from impact. The housing also comprises channels which communicate the electrical leads from the light bulbs to the switch and the connections to the battery's terminals, securing the leads from crimping or snagging. A recessed area is provided for securing a pressure sensitive switch therein, bordered by columns which protect the switch from inadvertent activation. Platforms project from the columns and provide a mounting location for clips which connect to the battery's terminals, and wings project from the platforms in a preferred embodiment to resist dog-earing of the corners. In another preferred embodiment, the platforms include pegs which mate with apertures on the clips to secure the clips to the housing and also to properly position the clips in relation to the battery's terminals.

12 Claims, 2 Drawing Sheets

DISPOSABLE PLANAR FLASHLIGHT

BACKGROUND OF THE INVENTION

1. Field of the Invention

The present invention relates to flashlights in general, and in particular to an improved assembly for a disposable planar flashlight.

2. Description of Related Art

Like much of the technology in today's society, flashlight technology has become lighter, thinner, smaller, and more convenient due in part to the advances in the components which make up the flashlight. For example, the availability of batteries such as the thin 6 volt dry cell battery made by Polaroid Corporation of Cambridge, Mass., has reduced the size requirements of the flashlight itself to that slightly bigger than a credit card. One example of a planar light-weight flashlight is described in U.S. patent application Ser. No. 08/369,719, authored by this inventor and incorporated by reference herein. Other improvements include the advances, in smaller, more durable light bulbs which can produce more light than heretofore with the earlier light bulbs of the art.

The battery suggested by the above cited flashlight has the dimensions of an ordinary playing card and two terminals on a rear surface. The battery itself has a slight rectangular bulge projecting from the forward surface where the dry cell is located. The light bulbs are connected to the terminals using insulated wires, and tape may be used to secure the wires and the switch to the battery. The light bulbs are enclosed in the window area formed by the transparent sheet, but the whole assembly lacks a rigid structure to define the locations of each component.

Difficulties of the design of the disposable "credit card" flashlight art concern the assembly of the flashlight and its durability. Previous attempts to secure the contacts and the switch to the battery have involved adhesives and tape, which are unreliable and subject to temperature changes. Furthermore, assembly of the flashlights due to the taping of wires was too labor intensive for a product designed to be disposable. Another drawback is the lack of a protective element for the pressure sensitive on-off switch, allowing the switch to be inadvertently activated when stored in tight places such as a wallet or purse. This inadvertent activation could lead to the flashlight's premature expiration, which in turn leads to customer dissatisfaction. The lack of a protective element also concerns the fragile nature of the small light bulbs, which may be broken or crushed if care is not exercised. The design further lacks a rigid structure, allowing the wires and light bulbs to be positioned by tape or other temporary adhesive measures. Finally, the contacts may become misaligned or disconnected since the tape or adhesive does not provide any support for the elements.

SUMMARY OF THE INVENTION

The object and general purpose of the present invention is accomplished by a one-piece housing for the flashlight bulb, switch, and contacts which is easily mounted on a thin battery for quick assembly. The housing comprises a generally planar member of preferably plastic construction which may be pre-formed for easy installation. The housing includes resilient C-shaped clamp members for releasably securing the bulbs of the flashlight while protecting the bulbs from a compressive or lateral force. The bulbs are protected by the C-shaped clamps, and also by a protruding bumper which projects beyond the plane of the light bulbs to deflect contact from the bulbs. The housing further comprises a recessed area for holding the pressure sensitive switch, necessitating a probing force to activate the pressure sensitive switch thereby reducing the possibility that the switch may be depressed inadvertently. Channels in the housing provide designated pathways for electrical wires connecting the contacts with the switch and the light bulbs, and the contacts are secured to the housing to prevent dislodging. The housing provides a light-weight but protective barrier for the fragile elements of the flashlight, increasing reliability while decreasing assembly time.

The housing provides protection to the bulbs and creates a reliable connection with the battery to increase performance. The housing leads to a more aesthetic appearance, and also reduces the occurrence of inadvertent activation by forming a protective border around the pressure sensitive switch. The improvement practically eliminates temperature concerns from the performance of the flashlight contacts by replacing the adhesives and tapes with a mechanical fixture.

BRIEF DESCRIPTION OF THE DRAWINGS

The exact nature of this invention, as well as its objects and advantages, will become readily apparent upon reference to the following detailed description when considered in conjunction with the accompanying drawings, in which like reference numerals designate like components throughout the figures thereof, and wherein.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the general principles of the present invention have been defined herein specifically to provide an improved, easy to assemble planar flashlight with a protective housing.

Figure 1:
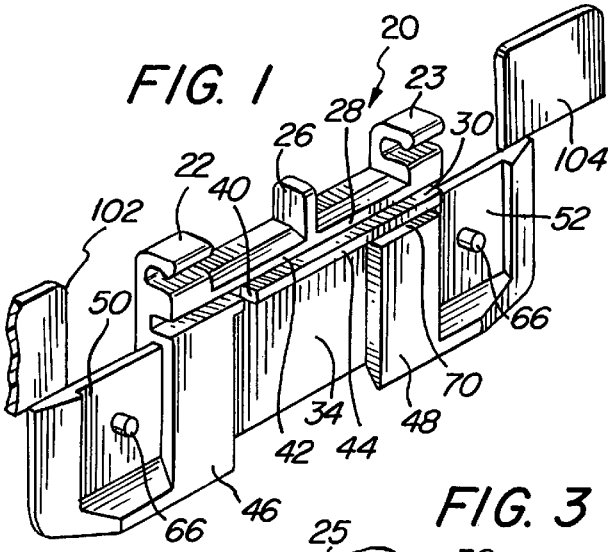
FIG. 1 is a perspective view of the housing of the present invention.
Figure 2:
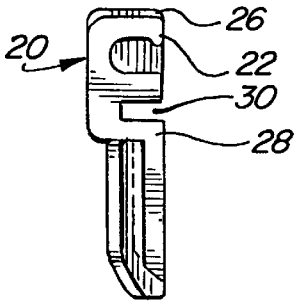
FIG. 2 is a side view of the housing of the present invention.
Figure 3:
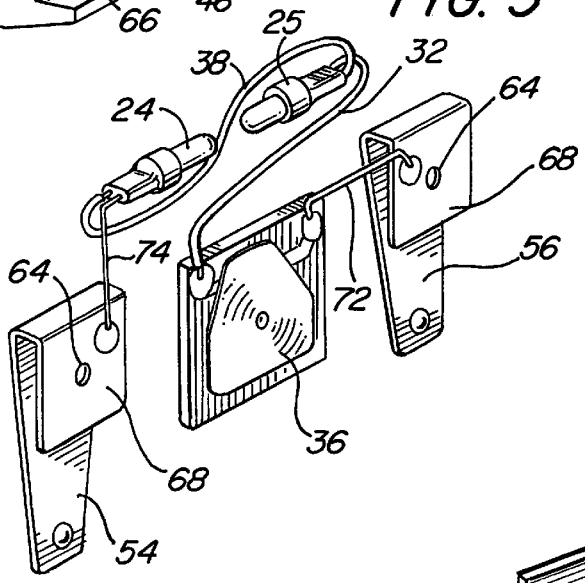
FIG. 3 is an perspective view of the elements mounted to the housing.
Figure 4:
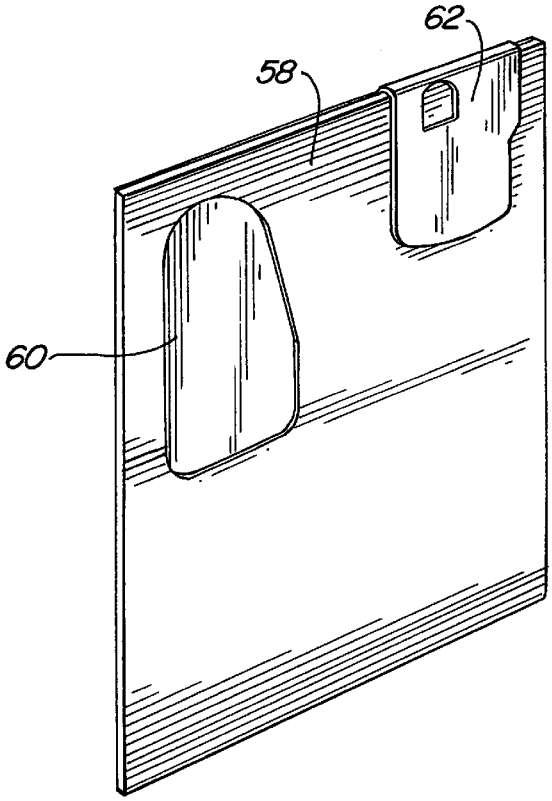
FIG. 4 is a perspective view of the battery of a preferred embodiment.

A preferred embodiment of a housing 20 of the present invention is illustrated generally in FIGS. 1 and 2. The housing 20 of the present invention is preferably fabricated from a plastic material which can be easily molded and will not suffer appreciable strength degradation in the temperature environment of the flashlight. The housing 20 preferably comprises two C-shaped clamps 22,23 which resiliently grasp the shafts of light bulbs 24,25 for quick insertion and release, and a bumper 26 disposed between the bulbs 24,25 to protect the bulbs from impact. Other clamp shapes for securing the bulbs are possible, and the invention is not limited to any one shape. The bumper 26 and the C-shaped clamps project beyond the diameter of the light bulbs. This feature makes contact to the flashlight from a direct line more likely to impact the bumper 26 or clamps 22,23 than the light bulbs 24,25 thereby protecting the bulbs. The bumper 26 and the C-shaped clamps 22,23 are preferably integrally connected to a traverse member 28 along a top surface.

The traverse member 28 includes a channel 30 which forms a pathway for an electrical lead 32 to extend from one light bulb 25 to a recessed area 34 which houses the pressure sensitive switch 36. Another lead 38 connecting the first bulb 24 to the second bulb 25 also traverses the channel 30 (shown outside the channel in FIG. 5 for clarity). The channel 30 includes an opening 40 into the recessed area 34 allowing access to the recessed area, and the walls 42,44 of the channel 30 provide a protective barrier for the leads 32,38.

Two thick columns 46,48 depend from the traverse member 28 and border recessed area 34 on both sides, with the traverse member 28 forming a third border on an upper edge of the recessed area 34. The recessed area 34 seats the pressure sensitive switch 36 so that the two columns 46,48 and the traverse member 28 extend above the switch 36. That is, the height of the columns 46,48 and the traverse member 28 form a boundary about the pressure sensitive switch 36 that prevents the switch from becoming depressed unless a probing force is applied. A general compressive force such as might be applied when the flashlight of the present invention is stored in a wallet will not cause the pressure sensitive switch 36 to be activated due to its position within the recessed area 34 protected by the thick columns 46,48 and/or the traverse member 28.

Figure 6:
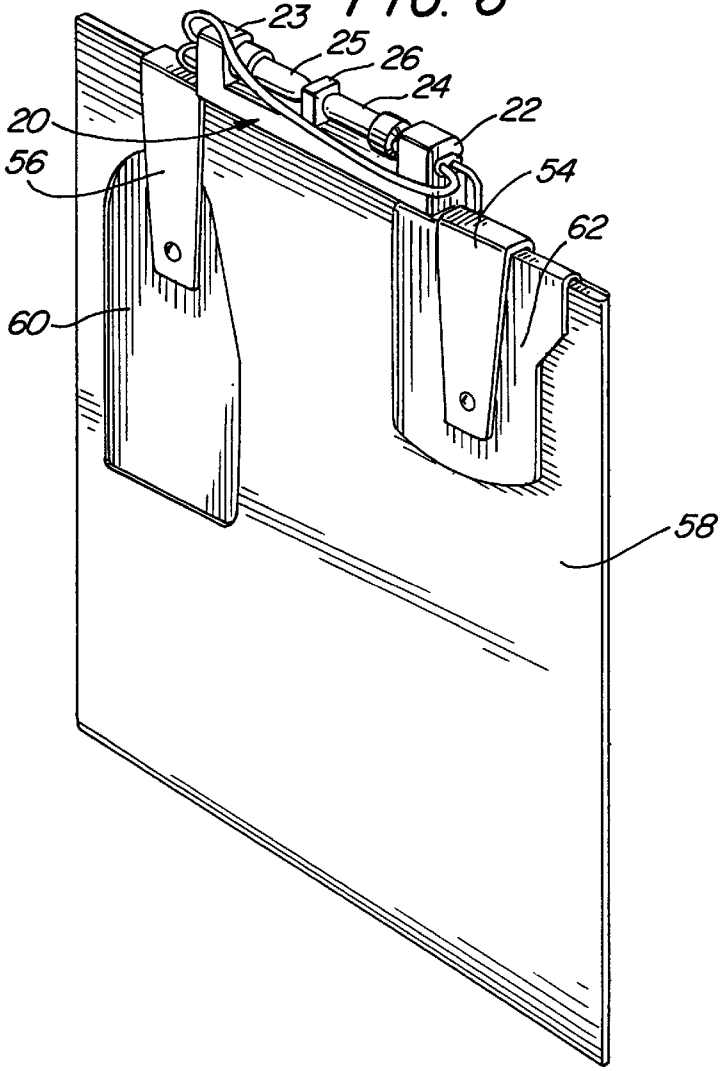
FIG. 6 is a rear perspective view of the flashlight assembly.
Figure 5:
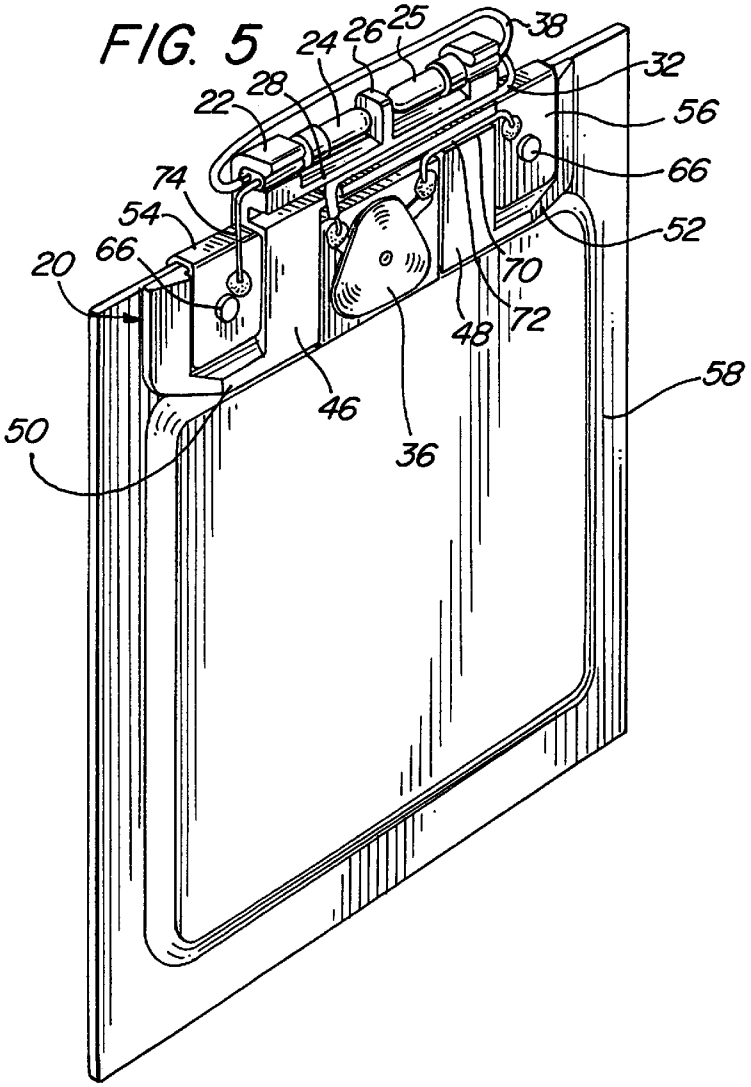
FIG. 5 is a front perspective view of the flashlight assembly.

Connected to each column 46,48 are platforms 50,52 which mount an electrical contact 54,56 on the housing 20. The platforms 50,52 are thinner than the adjacent columns 46,48 such that the thickness of the platforms 50,52 and the electrical contacts 54,56 are overshadowed by the adjacent columns 46,48. The electrical contacts 54,56 are preferably a type of resilient metal clips which conveniently hold the housing 20 to the battery 58 while maintaining an electrical contact with one of the battery's two terminals 60,62. FIGS. 5 and 6 illustrate a pair of contacts 54,56 mounting to the platforms of the housing, and further shows the contacts forming a electrical connection with the battery's terminals 60,62 on the rear surface of the battery 58. Each contact preferably includes an aperture 64 centered on the front panel 68 of the clip. The aperture 64 mates with a peg 66 integrally formed on each platform 50,52 to releasably secure the contacts 54,56 to the housing 20. With the contacts firmly mounted to the housing, the pegs 66 and apertures 64 ensure that the clip is properly positioned to contact the battery's terminals 60,62 on the rear surface of the battery 58, and also prevents the clip from becoming dislodged from the housing.

Connected to the platforms 50,52 in a preferred embodiment are extensions 102, 104 as shown (only) in FIG. 1. The extensions are sized to generally span the width of the flashlight and serve to reduce the occurrence of dog-earing at the unsupported comers. The extensions 102, 104 also center the housing between the edges of the flashlight, which presents a sturdier, more aesthetically pleasing appearance.

A pressure sensitive switch 36 such as a dome switch is mounted in the recessed area 34 such that it is protected on the upper and lateral surfaces by the traverse member 28 and the thick columns 46,48, respectively. A dome switch provides a durable, releasable switch that returns to its original position after a deploying pressure is released. Although the thickness of the battery 58 provides some protection from the inadvertent activation of the switch, a localized barrier around the switch such as that formed by the thick columns and the traverse member provides a more reliable guard against accidental activation. The switch 36 may be affixed to the recessed area 34 using an adhesive or any other means, or slots (not shown) may be formed along outer edges of the recessed area for securing the switch 36 therein. A groove 70 formed in the thick column 48 permits a lead 72 to extend from the contact 56 on the platform 52 to the switch 36 in the recessed area 34. A second lead 74 connects the contact 54 with the light bulb 24, completing the circuit between the terminals 60,62 of the battery 58. As shown in FIGS. 5 and 6, the battery's terminals 60,62 are contacted by the clips (contacts) 56,54 at the rear surface of the battery 58. Following the circuit around, clip 54 connects to battery terminal 62, and wire 74 extends from clip 54. The light bulb 24 connects to the wire 74, and wire 38 traversing the channel 30 connects the two light bulbs 24,25. Wire 32 connects the light bulb 25 with the switch 36, and wire 72 connects the switch 36 with the clip 56. Finally, the clip 56 contacts the battery terminal 60.

The housing 20 of the present invention maintains the planar nature of the flashlight while increasing it resistance to damage. The resiliency of the clips 54,56 cooperate with the housing 20 to mount the structure onto the battery 58. The housing 20 can be pre-assembled with the switch 36 and the light bulbs 24,25 such that the addition of the battery 58 requires only that the clips 54,56 be mounted onto the battery 58. Assembly is more reliable and faster than before, and the contacts with the battery terminals 60,62 are more dependable. To aid in the assembly process, the edges are smoothed and softened to lessen the occurrences of snagging on the exterior. Moreover, the housing shape is designed to fit into the cavity of the exterior container to eliminate any visual manifestations of the housing when enclosed in its container. The aesthetic appearance is improved by a more sturdy, organized presentation, and the housing can be colored to match the exterior of the flashlight. An exterior can be added to the flashlight comprising a cardboard covering or plastic housing, or any suitable protective structure which adheres to the disposable, planar nature of the flashlight.

It will be understood that the embodiment described herein are merely exemplary and that a person skilled in the art may make many variations and modifications without departing from the spirit and scope of the invention. All such variations and modifications are intended to be included within the scope of the invention as defined in the appended claims.

What is claimed is:

1. An improved planar flashlight comprising:

a planar power source;

at least one light bulb; and a housing mounted to said planar power source and comprising a substantially planar body having first and second spaced apart columns and a recessed switch area therebetween, said switch area sized to receive a pressure sensitive switch substantially therein with said first and second columns extending above said pressure sensitive switch, and first and second platforms, each depending from one of said first and second columns and adapted to receive an electrical contact substantially thereon; and first bulb securing means integrally connected with said planar body.

2. An improved planar flashlight as recited in claim 1 further comprising means for securing said electrical contacts to said first and second platforms.

3. An improved planar flashlight as recited in claim 2 wherein said means for securing said electrical contacts to said first and second platforms comprises an integral peg protruding from each of said first and second platforms and sized to engage a hole in said electrical contact.

4. An improved planar flashlights as recited in claim 1 further comprising second bulb securing means integrally connected with said planar body and spaced from said first bulb securing means.

5. An improved planar flashlight as recited in claim 1 wherein said first and second platforms have a thickness such that a height of a combination of the electrical contact and the platform is less than a height of the column adjacent thereto.

6. An improved planar flashlight as recited in claim 1 wherein said first bulb securing means comprises a resilient C-shaped clamp adapted to removably retain said bulb therein.

7. An improved planar flashlight as recited in claim 1 further comprising a first channel connecting said recessed switch area with a bulb disposed in said first bulb securing means, said first channel sized to communicate an electrical lead therein.

8. The improved planar flashlight as recited in claim 1 further comprising a passage in one of said first and second columns, said passage connecting said recessed switch area and one of said first and second platforms, said passage sized to communicate an electrical lead from an electrical contact on said platform to said pressure sensitive switch.

9. The improved planar flashlight as recited in claim 1 further comprising bumper means adjacent said first bulb securing means and projecting from said housing for deflecting contact from an impacting body prior to impact with a bulb in said bulb securing means.

10. The improved planar flashlight as recited in claim 1 further comprising first and second extensions connected to said platforms and projecting substantially to first and second corners of said flashlight.

11. A planar flashlight assembly comprising:

a light bulb;

a planar power source;

first and second electrical contacts, said first electrical contact operably connected to said light bulb;

a pressure sensitive electrical switch operably connected to said second electrical contact; and a one piece planar housing adapted to releasably secure in an operable relationship the light bulb, the first and second electrical contacts, and the pressure sensitive switch, said one piece planar housing comprising:

a resilient clamp adapted to secure the light bulb therein;

a first recessed region sized to receive the pressure sensitive switch therein, and channels connecting said recessed region with said light bulb and said electrical contacts with said light bulb.

12. A disposable planar flashlight comprising:

a planar power source including first and second electrical contacts on a first surface thereof;

a light bulb;

a pressure sensitive switch;

first and second electrically conducting clamps, said first clamp connected to said light bulb and said second clamp connected to said pressure sensitive switch; and a one piece planar housing comprising peg means for securing said first and second clamps to said one piece planar housing such that said first and second clamps are properly positioned to contact said first and second electrical contacts on said planar power source, said one piece planar unit further comprising means for securing said pressure sensitive switch thereto, and means for releasably securing said light bulb thereto.

* * * * *